US007878770B2

(12) United States Patent
Oka

(10) Patent No.: US 7,878,770 B2
(45) Date of Patent: Feb. 1, 2011

(54) HYDRAULIC CIRCUIT OF CONSTRUCTION MACHINE

(75) Inventor: Hidekazu Oka, Hiroshima (JP)

(73) Assignee: Kobelco Construction Machinery Co., Ltd., Hiroshima-shi (JP)

( * ) Notice: Subject to any disclaimer, the term of this patent is extended or adjusted under 35 U.S.C. 154(b) by 194 days.

(21) Appl. No.: 11/678,795

(22) Filed: Feb. 26, 2007

(65) Prior Publication Data

US 2007/0204607 A1 Sep. 6, 2007

(30) Foreign Application Priority Data

Feb. 27, 2006 (JP) ..... 2006-050284

(51) Int. Cl.
*F04B 49/08* (2006.01)

(52) U.S. Cl. ..... 417/278

(58) Field of Classification Search ..... 417/278
See application file for complete search history.

(56) References Cited

U.S. PATENT DOCUMENTS 4,437,385 A * 3/1984 Kramer et al. ..... 91/361
5,875,865 A * 3/1999 Wakahara et al. ..... 180/248
5,941,155 A * 8/1999 Arai et al. ..... 91/38
6,148,548 A 11/2000 Tohji
6,378,303 B1 * 4/2002 Higuchi et al. ..... 60/468
6,430,922 B2 8/2002 Tohji
6,560,962 B2 * 5/2003 Sawada et al. ..... 60/452
6,615,581 B2 * 9/2003 Kusuyama ..... 60/328
6,655,135 B2 * 12/2003 Oka ..... 60/329
6,708,490 B2 3/2004 Toji et al.
6,772,590 B2 * 8/2004 Tsuruga et al. ..... 60/468
6,837,140 B2 * 1/2005 Oka et al. ..... 91/436
7,059,125 B2 * 6/2006 Oka et al. ..... 60/422
7,155,909 B2 1/2007 Toji
7,168,246 B2 1/2007 Toji et al.
7,178,333 B2 2/2007 Oka
7,251,933 B2 * 8/2007 Tsuchiya et al. ..... 60/403
7,287,375 B2 * 10/2007 Goto et al. ..... 60/468
7,331,175 B2 * 2/2008 VerKuilen et al. ..... 60/429
7,454,906 B2 * 11/2008 Kauss et al. ..... 60/469

(Continued)

FOREIGN PATENT DOCUMENTS

EP 1020648 7/2000

(Continued)

*Primary Examiner*—Devon C Kramer
*Assistant Examiner*—Bryan Lettman
(74) *Attorney, Agent, or Firm*—Oblon, Spivak, McClelland, Maier & Neustadt, L.L.P.

(57) ABSTRACT

A hydraulic circuit for actuating an electromagnetic proportional pressure reducing valve by a command current outputted from a controller based on an operation amount of a remote control valve, and by a secondary pressure of the pressure reducing valve, actuating a common bleed-off valve which is a hydraulic pilot type spool valve is provided. In the controller, as a correction processing for correcting characteristics of a proportional valve command value which is a current value given to the pressure reducing valve and the opening area of the spool valve, at an inflection point at which the degree of change of a pump pressure increases, an actual proportional valve command value at a time of obtaining the pump pressure is compared to a theoretical proportional valve command value of a case of no tolerance, and a correction to compensate for a difference between the both command values is performed.

4 Claims, 5 Drawing Sheets

U.S. PATENT DOCUMENTS

| | | | | |
|---|---|---|---|---|
| 2002/0007630 | A1* | 1/2002 | Saito et al. | 60/468 |
| 2002/0007631 | A1* | 1/2002 | Sato et al. | 60/468 |
| 2002/0014075 | A1* | 2/2002 | Sawada et al. | 60/468 |
| 2002/0112475 | A1* | 8/2002 | Cannestra | 60/468 |
| 2004/0020196 | A1* | 2/2004 | Goto et al. | 60/468 |
| 2004/0118115 | A1* | 6/2004 | Bird et al. | 60/468 |
| 2005/0011190 | A1* | 1/2005 | Bitter | 60/468 |
| 2005/0044849 | A1* | 3/2005 | Berthod et al. | 60/468 |
| 2005/0204736 | A1* | 9/2005 | Toji et al. | 60/468 |
| 2006/0021341 | A1* | 2/2006 | Zitterbart | 60/468 |
| 2007/0095059 | A1* | 5/2007 | VerKuilen et al. | 60/468 |

FOREIGN PATENT DOCUMENTS

| | | |
|---|---|---|
| JP | 2-134404 | 5/1990 |
| JP | 6-307409 | 11/1994 |
| JP | 11-303809 | 11/1999 |

* cited by examiner

HYDRAULIC CIRCUIT OF CONSTRUCTION MACHINE

BACKGROUND OF THE INVENTION

1. Field of the Invention

The present invention relates to a hydraulic circuit of a hydraulic construction machine such as a hydraulic excavator.

2. Description of the Related Art

For example, in the hydraulic excavator, a structure has been used that a hydraulic pilot type control valve is actuated by an operation of an operation means (hereinafter, as an example, a remote control valve is described) to actuate a hydraulic actuator.

In such a structure, a bleed-off control is performed that based on an operation amount of the operation means, a flow rate of pouring from a pump to a tank (that is, a supply flow rate to a hydraulic actuator) is changed.

With respect to the bleed-off control, for example, as disclosed in Japanese Unexamined Patent Application Publication No. 11-303809, a technique of using a common bleed-off control system in which a bleed-off valve for bleed-off is commonly used for a plurality of control valves (hydraulic actuators) has been known.

In the common bleed-off control system, an operation pilot pressure of a remote control valve is detected by a pressure sensor and is sent to a controller. From the controller, a command current is given to an electromagnetic proportional pressure reducing valve (hereinafter, referred to as a proportional valve according to its common name) so as to change the secondary pressure, and with the secondary pressure, an opening area of the common bleed-off valve, which is a spool valve of hydraulic pilot type, is changed.

However, between the operation amount and the proportional valve, difference is generated in each machine due to the instruction current and a tolerance of the secondary pressure of the proportional valve. That is, in each opening area of the bleed-off valve with respect to the same operation amount, individual difference in each machine is generated.

In such a case, behavior of the hydraulic actuators (for example, starting points) with respect to an operation differs in each machine, and the operationality becomes worse.

Accordingly, it is desirable to correct the relation between the operation amount and the proportional valve secondary pressure in each machine.

As a technique related to the above, Japanese Unexamined Patent Application Publication No. 2-134404 has been known. In this publication, in a hydraulic circuit that a proportional valve is actuated in response to a command current from a controller based on an operation amount and a control valve is controlled by its secondary pressure, the secondary pressure of the proportional valve is detected by a pressure sensor and the detected pressure is fed back to the controller. Then, the command current value is corrected to compensate for the displacement of the change of the secondary pressure with respect to the change of the command current.

Then, it is possible to apply the correction technique to the technique for correcting the characteristics of the command current value (operation amount) and the proportional valve secondary pressure.

However, if the technique disclosed in Japanese Unexamined Patent Application Publication No. 2-134404 is directly used, to the existing circuit, new equipment, that is, the pressure sensor for detecting the proportional valve secondary pressure and the wiring equipment between the sensor and the controller, should be added. Then, the cost increases and it is difficult to additionally install the equipment to the existing device.

SUMMARY OF THE INVENTION

Accordingly, it is an object of the present invention to provide a hydraulic circuit of construction machine capable of correcting the characteristics of the operation amount and the proportional valve secondary pressure only by improving the program of the controller using the existing equipment.

First, the hydraulic circuit of construction machine according to the present invention includes the following basic structure.

That is, the hydraulic circuit according to the present invention includes operation means, a controller for outputting a command current based on an operation amount of the operation means, an electromagnetic proportional pressure reducing valve actuated by the command current outputted from the controller, and a hydraulic pilot type spool valve actuated by a secondary pressure of the electromagnetic proportional pressure reducing valve, the spool valve being adapted to change a pump pressure in response to a change in an opening area of the spool valve. The controller, as a correction processing for correcting characteristics of a proportional valve command value which is a current value given to the electromagnetic proportional pressure reducing valve and the opening area of the spool valve, is configured to detect a pump pressure which has been set in advance and an actual proportional valve command value at a time of obtaining the pump pressure, compare the actual proportional valve command value to a theoretical proportional valve command value at which the set pump pressure is to be obtained in the case that a tolerance of the secondary pressure with respect to the proportional valve command value does not exist, and then perform a correction to compensate for a difference between the both command values.

Generally, in the hydraulic circuit of construction machine for driving a hydraulic pump with an engine, for the purpose of preventing an engine stall due to an overload, so-called horsepower control for decreasing a pump flow rate when a pump pressure increases is performed. Accordingly, a pump pressure sensor for detecting the pump pressure is provided.

Further, similarly to the above-described common bleed-off circuit, in the case that a circuit is configured to actuate the spool valve by the command current corresponding to the operation amount of the remote control valve from the controller, a pilot pressure sensor for detecting the operation amount of the remote control valve (pilot pressure) is also provided.

On the other hand, according to Bernoulli's principle, as described below, there is a certain relation between the pump pressure and the opening area of the spool valve. Accordingly, if the pump pressure is detected, the characteristic of the opening area can be obtained. Then, the opening area of the hydraulic pilot type spool valve can be determined by the secondary pressure of the proportional valve and the secondary pressure can be determined by the command current value (proportional valve command value) to be applied to the proportional valve. Accordingly, there is a certain relation between the pump pressure and the proportional valve command value, and if the pump pressure is detected, the proportional valve command value can be obtained.

In view of the above, in the present invention, with respect to a predetermined pump pressure, a proportional valve command value which is actually applied to the proportional valve is compared to a theoretical proportional valve command value of a case of no tolerance, and a correction is performed to compensate for the difference between the both command values. Accordingly, characteristics of the operation amount and the opening area of the spool valve can be similar respectively without reference to individual difference of each machine, and good operationality can be endured.

Further, as the sensors, only the pump pressure sensor for detecting the pump pressure and the pilot pressure sensor for detecting the operation amount are necessary. With the both sensors, the sensors which have been originally provided as the existing equipment as described above can be directly used without change. Accordingly, it is not necessary to add new equipment only for the correction.

That is, using the existing equipment, by only improving the program of the controller, the characteristics of the operation amount and the proportional valve secondary pressure can be corrected. Therefore, the circuit can be provided at low cost and can be readily additionally provided to the existing machine.

However, even if the opening areas of the spool valves are the same, some difference can be generated in the pump pressures caused by change in viscosity of oil or change in quality of oil due to the effect of oil temperature. That is, in the characteristics of the valve opening areas and the pump pressures, elements of instability exist.

On the other hand, with respect to the characteristics of the proportional valve command values and the opening areas, in the case that there is an inflection point at which the degree of change in the opening areas largely change, the pump pressures also change at this inflection point without reference to the elements of instability such as the change in viscosity of oil.

Accordingly, it is preferable to compare the proportional valve command values to the pump pressure at the inflection point as described below. In such a case, an accurate correction can be performed without reference to the elements of instability.

In the above-described hydraulic circuit of construction machine, with respect to the pump pressure, the inflection point at which a degree of change in the pump pressure largely changes to a change of the proportional valve command value can be set, and the controller can be configured to perform the correction based on a comparison of proportional valve command values at the inflection point.

Further, in the hydraulic circuit of construction machine, a plurality of the inflection points can be set, and the controller can perform the correction based on a comparison of proportional valve command values at the plurality of inflection points.

In such a case, because the correction (for example, a correction with direct function) based on the comparison between the proportional valve command values at the plurality of inflection points is performed, the correction accuracy can be further improved.

Generally, in the case that setting of the proportional valve command value and the proportional valve secondary pressure is carried out, a tolerance is set to be minimum value at a certain command current value, for example, at 400 mA.

Then, in the hydraulic circuit of construction machine, the controller can perform the correction based on a comparison of proportional valve command values at the inflection point and a point at which the tolerance of the secondary pressure with respect to the proportional valve command value becomes a minimum value. With this structure, the correction accuracy can also be improved.

Further, generally, the inflection point (inflection point of the pump pressure) of the opening area of the spool valve has been set in advance as characteristics of the operation amount and the actuator for the purpose of increasing response of the actuator in a certain operation area or the like. Accordingly, the inflection point can be used without change.

On the other hand, in the case that such an inflection point is not set for the spool valve in advance, the inflection point is to be newly provided.

Further, as a method for detecting an inflection point, in any one of the above structures, the controller obtains the inflection point from a differential pressure between steps of the pump pressure which changes stepwise.

In such a case, by obtaining the inflection point from the differential pressure between steps of the pump pressure which changes stepwise, the inflection point can be readily and accurately detected.

DESCRIPTION OF THE PREFERRED EMBODIMENTS

In this embodiment, in conformity to the description in the "Description of the Related Art", the hydraulic circuit for performing the common bleed-off control will be described as an example to which the present invention is applied.

Figure 1:
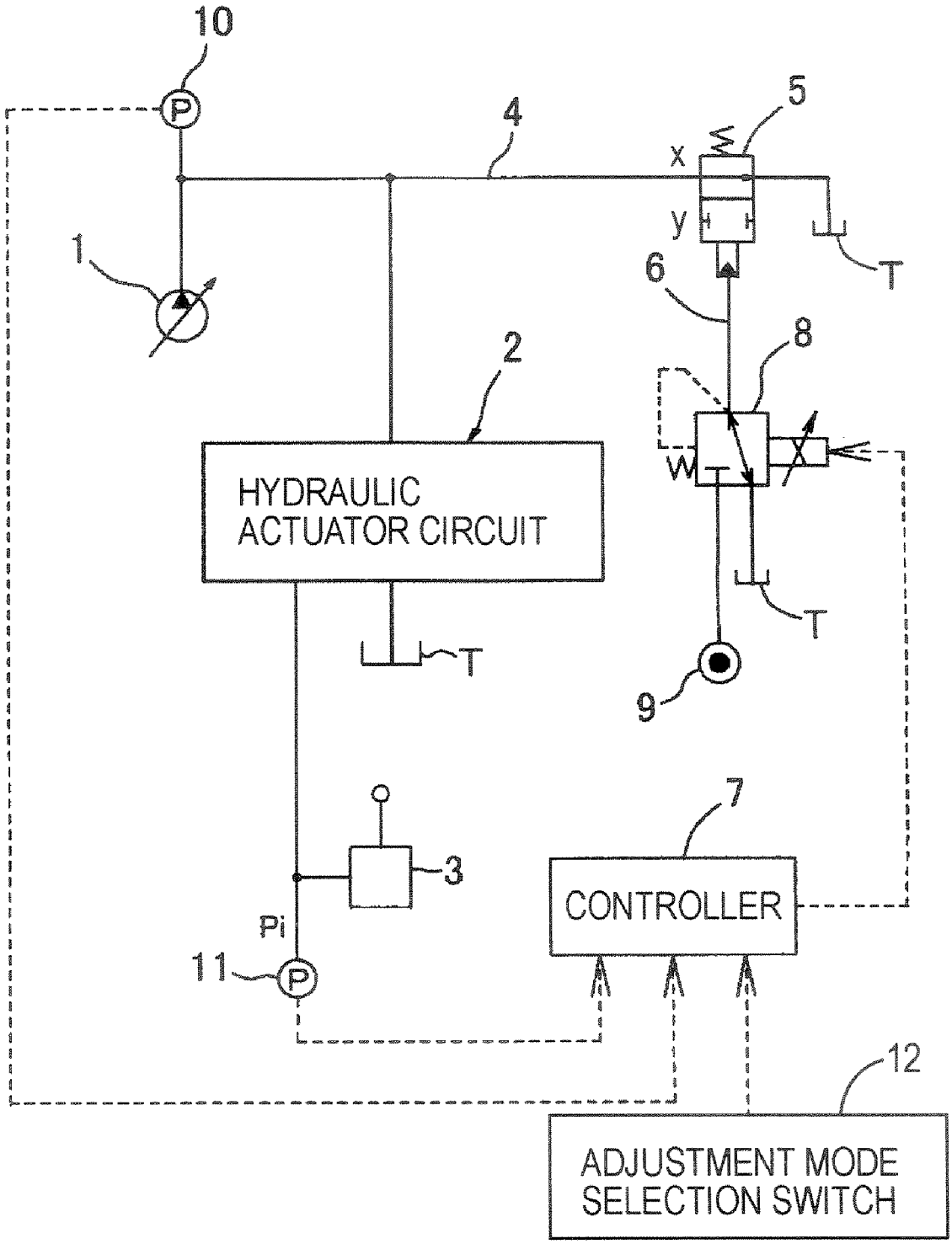
FIG. 1 is a view schematically illustrating a hydraulic circuit according to an embodiment of the present invention.

FIG. 1 shows the schematic structure of the hydraulic circuit.

Between a hydraulic pump 1 and a tank T, a hydraulic actuator circuit 2 is connected which includes a plurality of hydraulic actuators and a plurality of hydraulic pilot type control valves for individually controlling the hydraulic actuators.

The each control valve is operated by an individual remote control valve as an operation means. In this description, for the purpose of simplifying the explanation of the drawings and the description, only single remote control valve 3 is shown.

Further, between the hydraulic pump 1 and the tank T, a bleed-off line 4 is provided in parallel with the hydraulic actuator circuit 2. A common bleed-off valve 5 is provided in the bleed-off line 4 as a hydraulic pilot type spool valve for performing a bleed-off control at once in response to a remote control valve operation amount with respect to all hydraulic actuators.

The common bleed-off valve 5 executes the bleed-off control by performing stroke actuation between an unload position x at which the opening area becomes maximum, and a block position y at which the opening area becomes zero.

On a pilot line 6 of the common bleed-off valve 5, an electromagnetic proportional reducing valve (hereinafter, referred to as a proportional valve in conformity to the description in the "Description of the Related Art") 8 which is controlled by a controller 7 is provided. A secondary pressure of the proportional valve 8 is supplied to a pilot port of the common bleed-off valve 5 as a pilot pressure. Reference numeral 9 denotes a primary pressure source of the proportional valve 8.

As a sensor originally provided in the hydraulic circuit, a pump pressure sensor 10 for detecting a pump pressure to control horsepower and sending the detected pressure to the controller 7, and a pilot pressure sensor 11 for detecting a pilot pressure from the remote control valve 3 to perform a bleed-off control corresponding to an operation amount of the remote control valve 3 and sending the detected pressure to the controller 7 are included.

Reference numeral 12 denotes an adjustment mode selection switch. In the case of a shipment of the machine, a replacement of the proportional valve 8 or its related parts, or the like, if the switch 12 is turned on, the controller 7 enters into an adjustment mode. Then, an adjustment operation is executed which is for a correction processing (a correction of difference due to a tolerance of each machine with respect to a current value commanded from the controller 7 to the proportional valve 8 based on the remote control valve operation amount) executed at the time of the use of the machine, that is, each time of the operation.

Now, the adjustment operation and the correction processing will be described in detail below.

In a general operation, if the remote control valve 3 is operated, a pilot pressure outputted from the remote control valve 3 based on the operation amount is detected by the pilot pressure sensor 11, and the detected pressure is sent to the controller 7. Then, a command current is outputted from the controller 7 to the proportional valve 8. The relation between the pilot pressures Pi and the proportional valve command values is shown in step S6 in the flowchart of FIG. 4.

Figure 2:
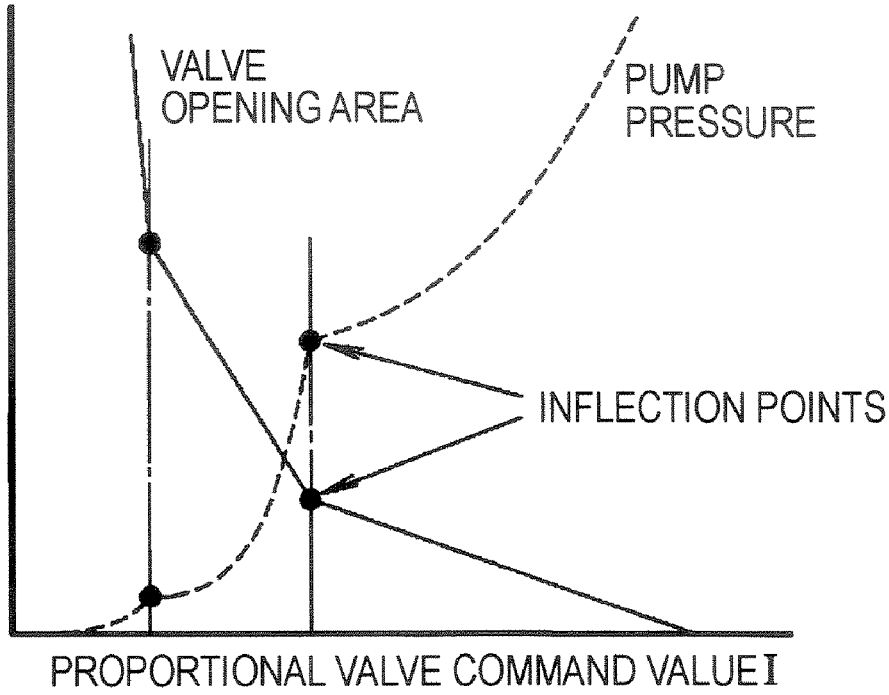
FIG. 2 is a view illustrating a relation between proportional valve command values, valve opening areas, and pump pressures in the hydraulic circuit.

On the other hand, FIG. 2 shows the relation between the proportional valve command values I, the opening areas of the common bleed-off valve 5, and pump pressures. As shown in the drawing, in the case that the proportional valve command values I increase, the opening areas decrease, and the pump pressures increase in proportion to the movement. That is, between the opening areas and the pump pressures, a certain relation exists. Accordingly, if the pump pressure is detected, the corresponding opening area can be obtained.

Then, the opening area (hereinafter, referred to as a valve opening area) of the common bleed-off valve 5 can be determined by the secondary pressure of the proportional valve 8, and the secondary pressure can be determined by the current value (proportional valve command value) applied from the controller 7 to the proportional valve 8.

Accordingly, between the pump pressures and the proportional valve command values, a certain relation exists. If the pump pressure is detected, the proportional valve command value can be obtained. Thus, with respect to a predetermined pump pressure, in the case that the proportional valve command value to be actually outputted from the controller 7 is compared to a theoretical proportional valve command value of a case of no tolerance, and a correction for compensating the difference between the both values is performed, characteristics of the operation amounts and valve opening areas of the all machines can be similar characteristics.

However, even if the valve opening areas are the same size, due to change in viscosity of oil caused by effect of oil temperature or the like, the pump pressure can be changed. That is, in the characteristics of the valve opening areas and the pump pressures, elements of instability exist, and even if the valve opening areas are the same size, some difference can be generated in the pump pressures. Accordingly, in the case that the proportional valve command values are compared with each other based on a pump pressure randomly extracted, an accurate correction may not be carried out.

The proportional valve command values and the opening areas are, basically, in proportional relationship. However, generally, for the purpose of increasing response of the actuators in a particular operation area, as shown in FIG. 2, inflection points (in this description, the case of two points is described), at which degrees of change in the opening areas with respect to the proportional valve command values increase, are set. At these inflection points of the opening areas, the degrees of change in the pump pressures also increase and inflection points also appear in the pump pressures.

At these inflection points of the pump pressures, even if the change in viscosity of oil or the like occurs, since the degrees of change in the pressure are large, points for comparison can be accurately detected. In the case that the inflection point is not previously set, an inflection point can be newly set.

In such a case, the inflection point can be detected by catching a boundary point at which the degree of change in the pump pressures largely changes. More particularly, for example, the following method can be employed.

Figure 3:
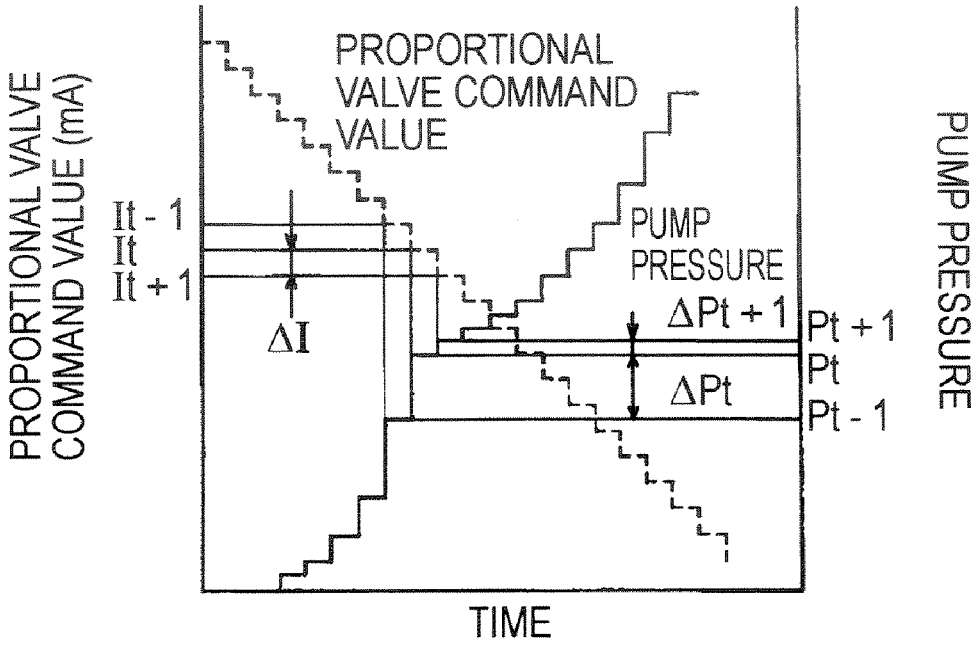
FIG. 3 is a view for explaining a method for obtaining an inflection point of a pump pressure in the hydraulic circuit.

As shown in FIG. 3, by increasing the proportional valve command value stepwise, the proportional valve secondary pressure increases stepwise. Thus, the proportional valve 8 strokes, the valve opening area decreases stepwise, and the pump pressure also changes stepwise. Then, the pump pressure is detected and a differential pressure between each step and the previous step is calculated.

In the example of FIG. 3, $It+1=It+\Delta I$, the pressure at the time is $Pt+1$, and the differential pressure between each step and the previous step is $\Delta P+1=Pt+1-Pt$. Then, the point at which the differential pressure $\Delta P+1$ becomes maximum is to be an inflection point, and the proportional valve command value I0 at the time is calculated.

In this embodiment, the actual value of the proportional valve command value at the inflection point at the pump pressure is compared to the theoretical value at the inflection point at the pump pressure.

The operation at this point is described with reference to the flowchart of FIG. 4.

Steps S1 to S4 show the adjustment operation carried out at the time of shipment of the machine or the like.

At step S1, an input status from the adjustment mode selection switch 12 of FIG. 1 is detected, and at step S2, whether the status is in the adjustment mode or not is determined.

In the case that it is determined that the status is in the adjustment mode, after the inflection point of the pump pressure is detected at step S3, the status enters in the adjustment mode off at step S4, and the process returns to step S2.

The processing after step S5 shows contents of the correction processing to be executed by a correction processing means at the time of use of the machine, that is, at each ordinary operation.

At step S5, after a pilot pressure Pi is input, at step S6, the proportional valve command value I0 is calculated according to the map set and stored with respect to the relation between the pilot pressures Pi and the proportional valve command values I0.

Figure 4:
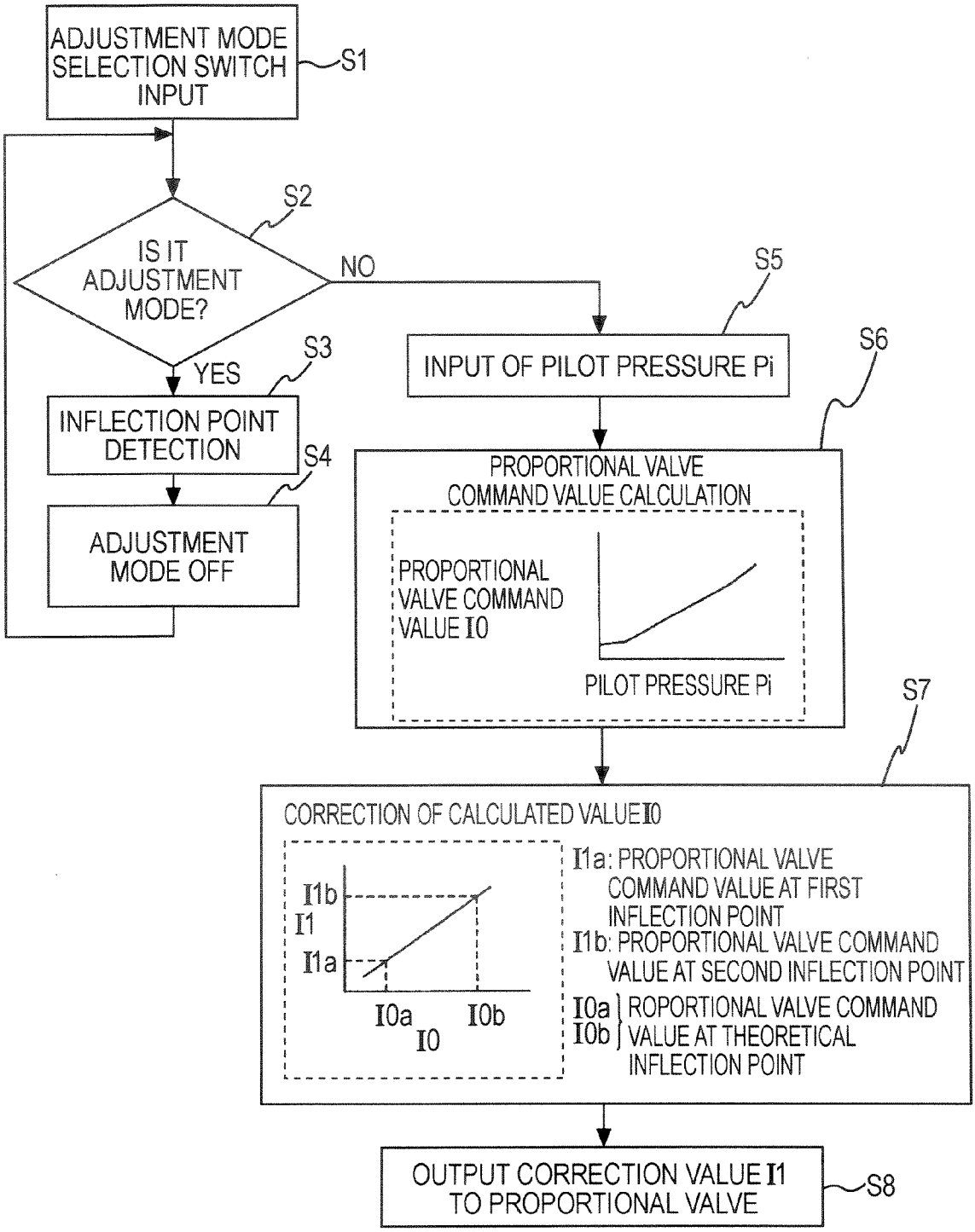
FIG. 4 is a flowchart for explaining contents of adjustment and correction processing in the hydraulic circuit.

Then, in the means for comparing at step S7 of FIG. 4, the values obtained at the two inflection points are compared with each other, that is, the actual proportional valve command values I1*a* and I1*b* are compared to the theoretical values I0*a* and I0*b*. Then, in the case that there is a difference between the both command values, the correction is executed to correct the difference to be zero.

For example, in the case that the proportional valve command value at an inflection point is, actually, 450 mA in a machine instead that the proportional valve command value should be, theoretically, 500 mA, with respect to the machine, the relation between the pilot pressure Pi and the proportional valve command value is set so that the pump pressure at the inflection point is to be 450 mA.

In this embodiment, the correction (for example, a correction with direct function) based on the comparison between the command values at the two inflection points is performed.

Then, at step S8, the correction value I1 which is a corrected proportional valve is output to the proportional valve 8.

By executing the correction processing, with respect to all machines, the similar inflection point can be obtained at the similar pilot pressure. That is, without reference to the tolerance of the proportional valve 8, the characteristics of the remote control valve operation amounts and the valve opening areas become similar, and with the similar operation amount, the similar movement of the actuator can be obtained. Accordingly, good operationality can be endured.

Further, according to this circuit, as shown in FIG. 1, as the sensors, only the pump pressure sensor 10 for detecting the pump pressure and the pilot pressure sensor 11 for detecting the operation amount (remote control valve pilot pressure) Pi are necessary. With the both sensors 10 and 11, the sensors which have been originally provided as the existing equipment as described above can be used without change. Accordingly, it is not necessary to add new equipment only for the correction. Therefore, the circuit can be provided at low cost and can be readily additionally provided to the existing machine.

Further, according to this embodiment, the proportional valve command values to the pump pressure at the inflection point are compared with each other. Accordingly, without reference to the elements of instability such as the change in viscosity of oil due to the effect of oil temperature, the accurate correction can be performed.

Further, since the correction is executed based on the comparison of the proportional valve command values at the two inflection points, the accuracy of the correction can be further increased.

Figure 5:
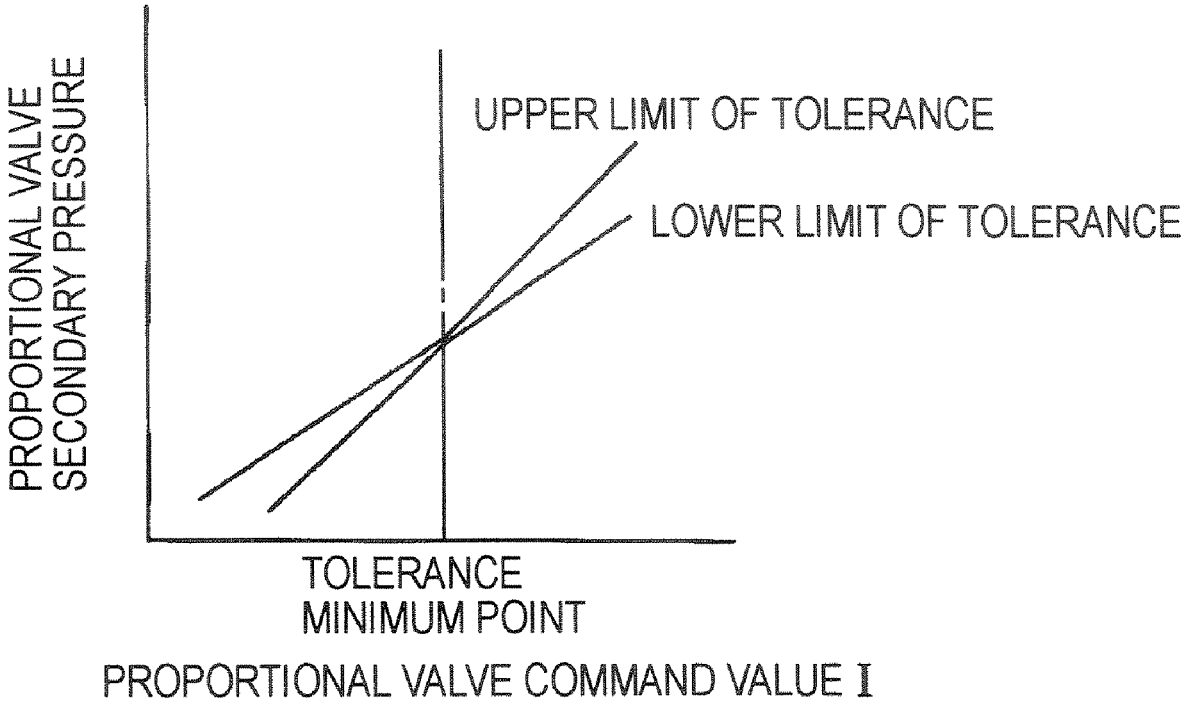
FIG. 5 is a view illustrating a relation of tolerances of proportional valve secondary pressure with respect to proportional valve command values.

Other Embodiments (1) In the case that the setting of the proportional valve command value and the secondary pressure is carried out, generally, as shown in FIG. 5, a tolerance of the proportional valve secondary pressure is set to be minimum value at a particular proportional valve command value I, for example, 400 mA.

Then, the correction can be performed based on a comparison between proportional valve command values at one inflection point obtained by the method described in the above embodiment and at the point at which the tolerance of the secondary pressure to the proportional valve becomes the minimum value. In such a case, the correction accuracy can also be increased as compared to the case that the comparison is performed only at one inflection point.

(2) In the above-described embodiment, as shown in the flowchart of FIG. 4, the adjustment processing is separated from the correction processing. The adjustment processing is executed at the time of shipment of the machine to obtain the inflection point, and based on the inflection point, the correction processing is executed at each operation of the machine. However, the invention is not limited to the structure, but an inflection point can be detected at the time of the operation of the machine. Moreover, based on the inflection point, a correction map can be formed with respect to the relation between the pilot pressures and the proportional valve command values, and a correction map which has been stored in advance and has not been corrected can be converted into the correction map.

Figure 6:
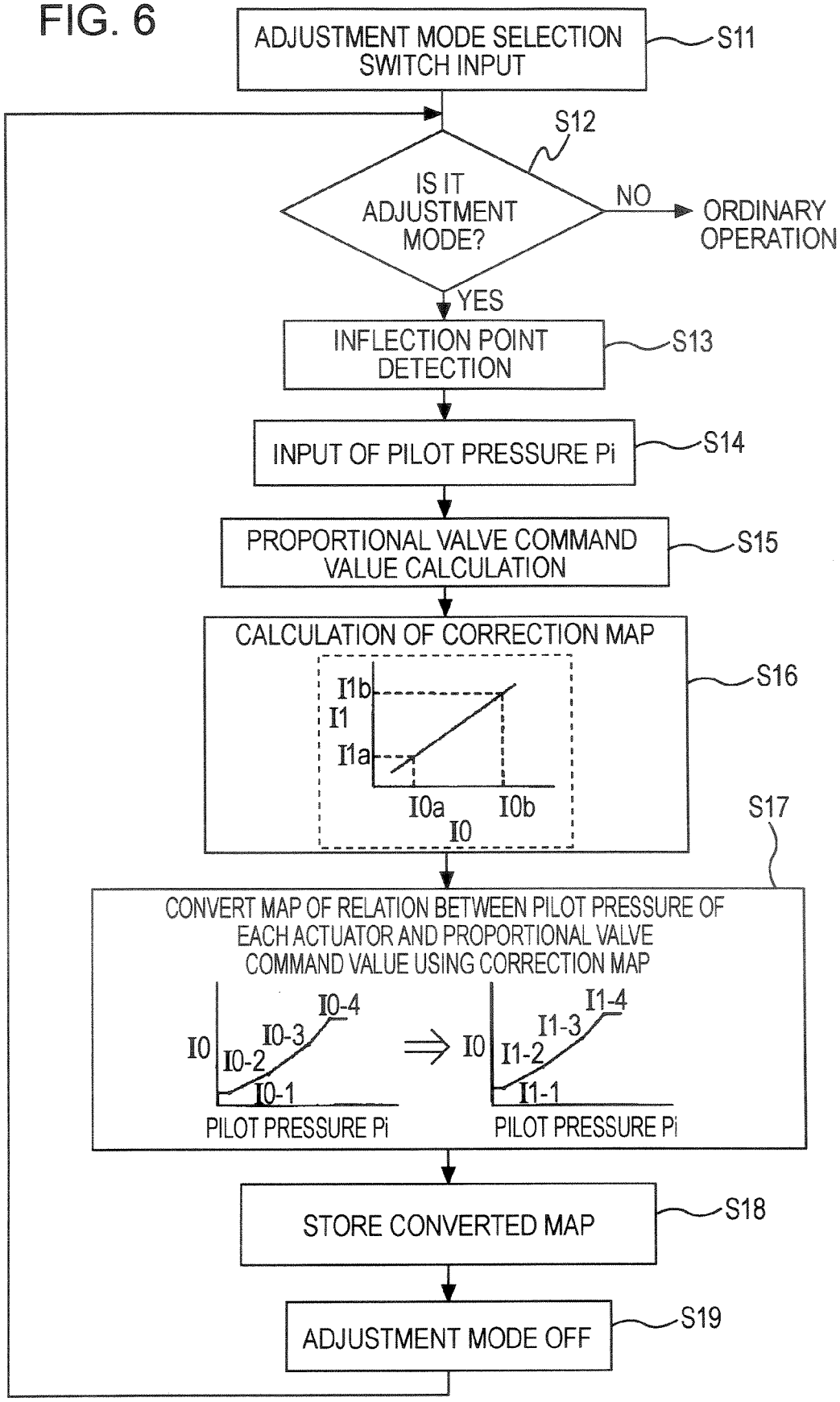
FIG. 6 is a flowchart for explaining contents of adjustment and correction processing by the hydraulic circuit according to another embodiment of the present invention.

For example, with reference to FIG. 6, at step S11, the input status from the adjustment mode selection switch 12 of FIG. 1 is detected, and at step S2, whether the status is in the adjustment mode or not is determined.

In the case that the status is in the adjustment mode, at step S13, by the similar processing at step S3 of FIG. 4, the inflection point of the pump pressure is detected.

Then, at step S14, the input of the pilot pressure Pi and at step 15, the calculation of the proportional valve command value I0 are executed respectively, and at step S16, using the method of step S7 of FIG. 4, a correction map is calculated. The correction map can be obtained, for example, by calculating a linear expression based on the correction value obtained based on the two inflection points.

At step S17, the map which has been stored in advance with respect to the relation between the pilot pressures and the proportional valve command values of each actuator is converted into the correction map, and the correction map is stored at step S18.

Then, at step S19, the adjustment mode is turned off, the processing returns to step S12, and enters in an ordinary operation.

With the structure, similar effect to the above-described embodiment can also be obtained.

(3) Although it is preferred that the comparison of the proportional valve command values is performed at the inflection point as described in the above embodiments, as a next-preferred method, the comparison of the proportional valve command values at the time can be carried out based on a single or a plurality of pump pressures as the point for the comparison.

(4) It is to be understood that the present invention is not limited to the hydraulic circuit which includes the common bleed-off valve described in the above embodiments, but can be widely applied to hydraulic circuits in which an electromagnetic proportional pressure reducing valve is actuated by a command current outputted from a controller corresponding to an operation amount of an operation means, in response to a secondary pressure of the electromagnetic proportional pressure reducing valve, a hydraulic pilot type spool valve is actuated, and a pump pressure is changed according to the change in an opening area of the spool valve.

Although the invention has been described with reference to the preferred embodiments in the attached figures, it is noted that equivalents may be employed and substitutions made herein without departing from the scope of the invention as recited in the claims.

What is claimed is:

1. A hydraulic circuit of construction machine comprising:

operation means;

a controller for outputting a command current based on an operation amount of the operation means;

an electromagnetic proportional pressure reducing valve actuated by the command current outputted from the controller; and a hydraulic spool valve actuated by a secondary pressure from the electromagnetic proportional pressure reducing valve, the spool valve being configured to change a pump pressure in response to a change in an opening area of the spool valve, wherein a degree of change in the pump pressure by the hydraulic spool valve to a change in the proportional valve command value exhibits at least one inflection point at which there is an inflection in the degree of change in the pump pressure for a predetermined change of the proportional valve command value;

the controller having correction processing means for correcting the proportional valve command value, comprising:

means for comparing, at the at least one inflection point, a detected actual proportional valve command value to a theoretical proportional valve command value at which the set pump pressure is to be obtained in the case that a tolerance of the secondary pressure with respect to the proportional valve command value does not exist, and means, based on the comparison, for performing a correction to compensate for a difference between the detected and theoretical command values at the inflection point.

2. The hydraulic circuit of construction machine according to claim 1, wherein said at least one inflection point comprises a plurality of the inflection points, and the controller performs the correction based on a comparison of proportional valve command values at the plurality of inflection points.

3. The hydraulic circuit of construction machine according to claim 1, wherein the controller performs the correction based on a comparison of proportional valve command values at the at least one inflection point and a point at which the tolerance of the secondary pressure with respect to the proportional valve command value becomes a minimum value.

4. The hydraulic circuit of construction machine according to claim 1, wherein the controller obtains the at least one inflection point from a differential pressure between steps of the pump pressure which changes stepwise.

* * * * *